US009671105B2

(12) United States Patent
Brodesser et al.

(10) Patent No.: US 9,671,105 B2
(45) Date of Patent: Jun. 6, 2017

(54) CONTINUOUS FLOW STEAM GENERATOR WITH A TWO-PASS BOILER DESIGN

(71) Applicant: Siemens Aktiengesellschaft, Munich (DE)

(72) Inventors: Joachim Brodesser, Nuremberg (DE); Martin Effert, Erlangen (DE); Tobias Schulze, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 14/909,610

(22) PCT Filed: Jul. 25, 2014

(86) PCT No.: PCT/EP2014/066062

§ 371 (c)(1),
(2) Date: Feb. 2, 2016

(87) PCT Pub. No.: WO2015/018667

PCT Pub. Date: Feb. 12, 2015

(65) Prior Publication Data

US 2016/0178188 A1 Jun. 23, 2016

(30) Foreign Application Priority Data

Aug. 6, 2013 (DE) ..... 10 2013 215 457

(51) Int. Cl.
*F22B 37/62* (2006.01)
*F22B 21/34* (2006.01)
*F22B 29/06* (2006.01)

(52) U.S. Cl.
CPC ..... *F22B 21/34* (2013.01); *F22B 21/345* (2013.01); *F22B 29/06* (2013.01); *F22B 29/062* (2013.01)

(58) Field of Classification Search
CPC ..... F22B 37/62
(Continued)

(56) References Cited

U.S. PATENT DOCUMENTS 3,102,514 A * 9/1963 Armacost ..... F22B 21/341 122/480
3,245,385 A * 4/1966 Koch ..... F22B 29/06 122/406.1

(Continued)

FOREIGN PATENT DOCUMENTS

CN 1127340 A 7/1996
CN 1254408 A 5/2000

(Continued)

OTHER PUBLICATIONS

CN Office Action dated Oct. 25, 2016, for CN patent application No. 201480044547.X.

(Continued)

*Primary Examiner* — Gregory A Wilson
(74) *Attorney, Agent, or Firm* — Beusse Wolter Sanks & Maire

(57) ABSTRACT

A continuous flow steam generator includes a combustion chamber, having substantially rectangular cross-section and a lower and upper combustion chamber region, and has a horizontal gas pass connected downstream of the combustion chamber on the flue-gas side. Gas-tight and gas-permeable peripheral walls of the generator are completely or partly made of steam generator pipes welded together and through which a flow medium can flow, and collectors are arranged and connected to the steam generator pipes such that groups of steam generator pipes connected in parallel form heating surface segments of the peripheral walls. First passage collectors are arranged and connected such that the flow medium from first heating surface segments of two parallel first peripheral walls of the lower combustion cham- (Continued)

ber region are mixed with the fluid medium from second heating surface segments of second peripheral walls, standing perpendicular to the first peripheral walls, of the upper combustion chamber region.

11 Claims, 1 Drawing Sheet

(58) Field of Classification Search
USPC ..... 122/7 R, 406.4
See application file for complete search history.

(56) References Cited

U.S. PATENT DOCUMENTS

| | | | | |
|---|---|---|---|---|
| 3,280,799 | A | 10/1966 | Schroedter | |
| 3,307,524 | A | 3/1967 | Ambrose | |
| 3,358,650 | A | 12/1967 | Olson et al. | |
| 3,368,535 | A * | 2/1968 | Svendsen | F22B 37/208 122/510 |
| 3,434,460 | A * | 3/1969 | Schroedter | F22B 29/023 122/406.4 |
| 3,545,409 | A * | 12/1970 | Young | F22B 29/061 122/406.4 |
| 3,548,788 | A | 12/1970 | Altman et al. | |
| 3,665,893 | A | 5/1972 | Barberton et al. | |
| 3,927,646 | A * | 12/1975 | Dungey | F22B 37/244 122/406.4 |
| 3,983,903 | A * | 10/1976 | Kuehn, Jr. | F22B 37/74 122/406.3 |
| 4,075,979 | A * | 2/1978 | Michel | F22B 29/065 122/235.12 |
| 4,869,210 | A | 9/1989 | Wittchow | |
| 5,560,322 | A | 10/1996 | Fitzgerald | |
| 6,192,837 | B1 | 2/2001 | Wittchow | |
| 6,651,596 | B1 * | 11/2003 | Wittchow | F22B 29/062 122/467 |
| 7,878,157 | B2 * | 2/2011 | Effert | F22B 29/062 122/406.1 |
| 8,851,023 | B2 | 10/2014 | Effert et al. | |
| 2002/0017251 | A1 * | 2/2002 | Wittchow | F22B 21/346 122/459 |
| 2008/0257282 | A1 | 10/2008 | Effert et al. | |
| 2009/0241859 | A1 | 10/2009 | Bairley et al. | |
| 2011/0162592 | A1 * | 7/2011 | Effert | F22B 21/345 122/406.4 |
| 2011/0197830 | A1 * | 8/2011 | Bruckner | F22B 21/341 122/406.4 |
| 2011/0203536 | A1 * | 8/2011 | Effert | F22B 19/00 122/7 R |
| 2011/0214622 | A1 * | 9/2011 | Effert | F22B 21/343 122/136 R |

FOREIGN PATENT DOCUMENTS

| | | | |
|---|---|---|---|
| CN | 102149970 | A | 8/2011 |
| DE | 102010038885 | A1 | 2/2012 |
| EP | 0308728 | A1 | 3/1989 |
| EP | 2182278 | A1 | 5/2010 |
| EP | 2213936 | A1 | 8/2010 |
| JP | S47007804 | A | 4/1972 |
| JP | H08327006 | A | 12/1996 |
| JP | H08327007 | A | 12/1996 |

OTHER PUBLICATIONS

JP Office Action dated Feb. 27, 2017, for JP patent application No. 2016-532307.

* cited by examiner

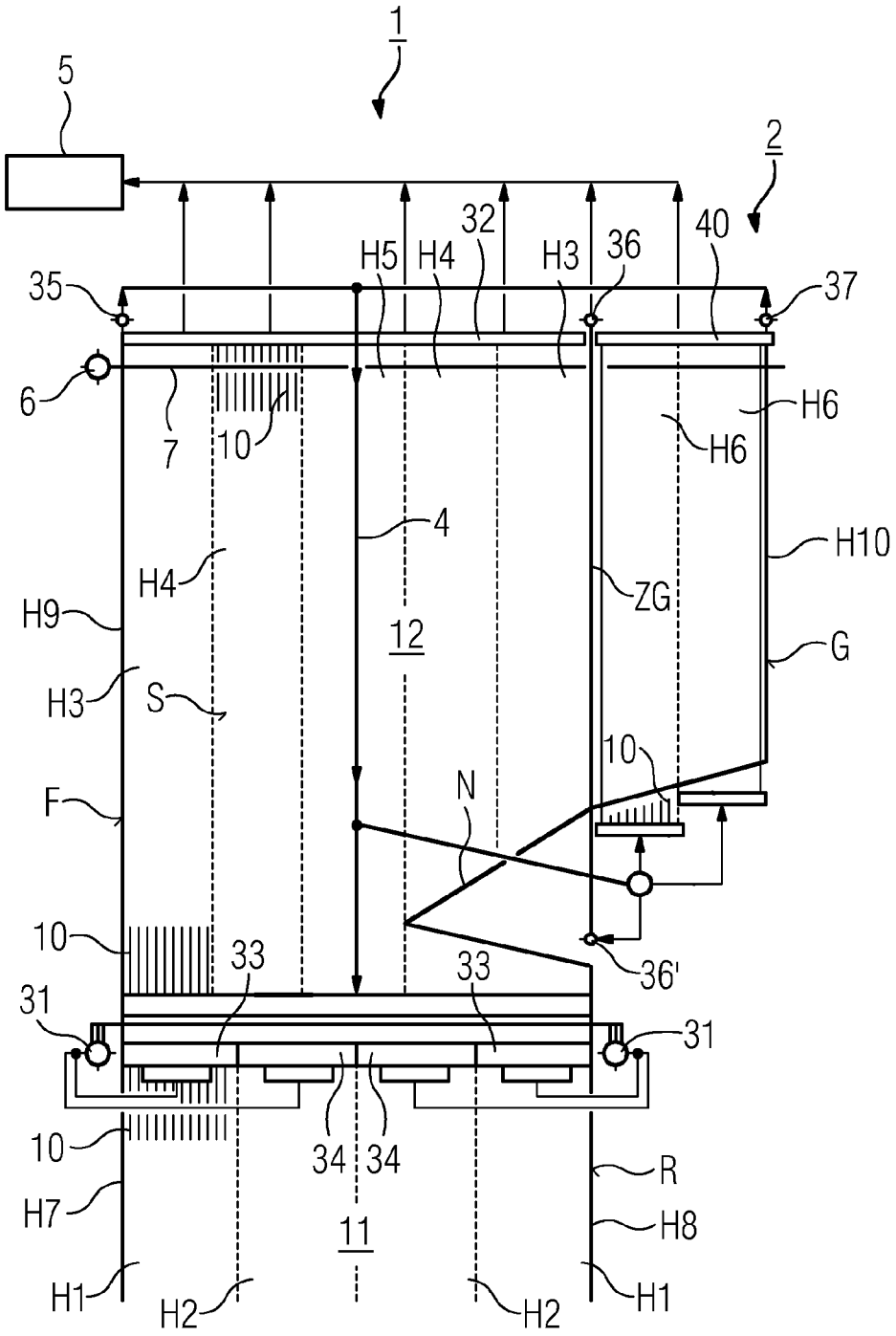
1
5
2
32
40
H5
H4
H3
36
35
37
6
7
10
H6
H6
4
H10
H4
ZG
H9
12
G
H3
S
10
F
N
10
33
33
36'
31
31
10
34
34
R
H7
11
H8
H1
H2
H2
H1

CONTINUOUS FLOW STEAM GENERATOR WITH A TWO-PASS BOILER DESIGN

CROSS REFERENCE TO RELATED APPLICATIONS

This application is the US National Stage of International Application No. PCT/EP2014/066062 filed Jul. 25, 2014, and claims the benefit thereof. The International Application claims the benefit of German Application No. DE 102013215457.7 filed Aug. 6, 2013. All of the applications are incorporated by reference herein in their entirety.

FIELD OF INVENTION

The invention relates to a continuous flow steam generator. The invention relates specifically to continuous flow steam generators for power plants, having a combustion chamber which is of substantially rectangular cross section, and having a horizontal gas pass which is connected downstream of the combustion chamber at the flue gas side and which may be adjoined by a further vertical gas pass.

BACKGROUND OF INVENTION

Such a construction, also referred to as a two-pass boiler, is known for example from EP 2 182 278 A1. Here, welded-together steam generator tubes through which a flow medium can flow form both the gas-tight enclosure walls and gas-permeable grate walls of the continuous flow steam generator. Correspondingly arranged collectors connected to the steam generator tubes make it possible to form different heating surface segments composed of groups of steam generator tubes, connected in parallel, of the enclosure walls. In principle, it is possible here for the steam generator tubes of the continuous flow steam generator to be arranged vertically and/or in helical or spiral-shaped fashion in part or over the entire length. Furthermore, the continuous flow steam generator may also be in the form of a continuous forced-flow steam generator.

DE 10 2010 038 885 A1 has disclosed a continuous flow steam generator with vertical tubing, referred to as a single-pass or tower boiler. In this case, the tubing of the enclosure walls is divided into a lower section and an upper section, which are connected to one another by a passage collector. The passage collector duly effects complete pressure equalization between the steam generator tubes without further measures, but effects only an incomplete mixing of the flow medium. Differences in the outlet temperature or outlet enthalpy of the steam generator tubes in the lower section are only partially compensated in the passage collector, and are therefore conducted onward, partially unmixed, to the steam generator tubes in the upper section. Since heating imbalances however also exist in the steam generator tubes of the upper section, local temperature differences of the flow medium in the steam generator tubes can intensify further within the enclosure walls, and can thus under some circumstances reach inadmissibly high values. If the temperature values exceed the scaling temperature of the material, or if inadmissibly high material stresses arise owing to the high temperature values, damage to the enclosure walls can occur, which must be avoided for reliable operation of the power plant.

Therefore, in DE 10 2010 038 885 A1, for a continuous forced-flow steam generator with parallel steam generator tubes in the upper section, it is proposed that the design parameters for said steam generator tubes be selected such that the mean mass flow density in said steam generator tubes at full load of the steam generator does not lie below 1200 kg/m2s. The homogenization of the flow distribution and avoidance of stagnation in the upper vertical tubing which are achieved in this way may however under some circumstances not suffice as a measure for reducing local temperature imbalances to such an extent that conventional materials, such as for example 13CrMo45 (T12), can be used. In such cases, it is then possible for more highly alloyed materials to be used. Accordingly, for the enclosure walls in particular of the upper section, the materials 7CrWVMoNb9-6 (T23) or 7CrMoVTiB10-10 (T24) are discussed or used, wherein, in the case of said materials, for reliable operation of the continuous flow steam generator and of the power plant as a whole, particular attention must be paid to the reliability and durability of the welded connections.

SUMMARY OF INVENTION

It is an object of the invention to provide a continuous flow steam generator which overcomes the above-described disadvantages.

Said object is achieved by way of the continuous flow steam generator having the features of the independent claim.

According to the invention, for continuous flow steam generators which are designed as two-pass boilers, with a horizontal gas pass connected downstream of the combustion chamber at the flue gas side, a novel connection configuration of steam generator tubes is proposed. Conventionally, in the case of such two-pass boilers, in the upper combustion chamber region, the steam generator tubes of the front wall, of the rear wall and of the side walls are connected in parallel. The steam generator tubes of the rear wall are then for example distributed over the rear wall surface, wherein one part forms the nose and the base of the horizontal gas pass and a grate at the end of the horizontal gas pass, and the other part, downstream of the nose, runs in unheated fashion and then, further upward, forms a grate at the transition from the combustion chamber to the horizontal gas pass. In the case of the novel connection configuration, it is now the case that first collectors are arranged and connected such that the flow medium flowing through the steam generator tubes from first heating surface segments of two parallel first enclosure walls from the lower combustion chamber region can be admixed to the flow medium from second heating surface segments of second enclosure walls which are perpendicular to the first enclosure walls, and thus an increase in the mass flow density and a homogenization of the temperatures can be achieved.

If the second enclosure walls are a front wall and a rear wall assembly, formed from the rear wall, from a nose and from a grate, of the upper combustion chamber region, and if the first enclosure walls are two side walls of the lower combustion chamber region, the mass flow available for tube cooling for the upper front wall and for the rear wall assembly is increased considerably, because this is now available, as well as the mass flow of the lower front wall and rear wall, to the admixed mass flow of the two lower side walls. With the greater mass flow, the mass flow density in the steam generator tubes of the heating surface segments of the front wall and rear wall assembly can be increased, whereby the cooling at said enclosure walls is improved. Furthermore, the heat supplied to said heating surface segments now leads to less of a temperature rise owing to the greater mass flow of the flow medium. Thus, specifically in the case of the enclosure walls in the upper combustion chamber region, and in particular in the case of the front wall of two-pass boilers, which conventionally exhibit very high heat absorption, it is possible owing to the higher mass flow density to achieve a homogenization of the inlet temperatures, and thus the operational reliability can be greatly increased.

In a further refinement of the invention, second passage collectors and at least one downpipe are arranged and connected such that the flow medium from the second enclosure walls of the upper combustion chamber region can be supplied to third heating surface segments of the enclosure walls of the upper combustion chamber region. Ideally, at the outlet of the upper front wall and of the grate at the end of the horizontal gas pass, the flow medium is collected in the corresponding collectors and supplied via two downpipes to in each case one of the two upper side walls, to the combustion chamber outlet grate and to the side walls of the horizontal gas pass.

Here, the first collectors are advantageously connected such that flow medium from heating surface segments composed of corner wall regions of the first enclosure walls from the lower combustion chamber region can be supplied and/or admixed to central wall regions of the second enclosure walls of the upper combustion chamber region. Here, at the outlet of the lower side walls, the relatively cold flow medium of the edge regions can be supplied to the relatively hot central regions of the upper front wall and rear wall. The relatively warm flow medium from the side wall center is admixed to the relatively cold zones of the edge regions of the front wall and rear wall. The mixture gives rise to a homogenization of the temperatures of the flow medium.

Altogether, it is thus possible with the present invention for the mass flow available for tube cooling, in particular for the upper front wall and rear wall, to be considerably increased. With the greater mass flow, the mass flow density in the steam generator tubes can be increased, whereby the cooling action is improved. Furthermore, the supplied heat of the two walls now leads to less of a temperature rise owing to the greater mass flow of the flow medium. Complete mixing can be assumed to take place in the downpipes downstream of the outlet collectors of front wall and rear wall and downstream of the grate of the horizontal gas pass. Since, as a result, there are no temperature imbalances from upstream heating surfaces at the inlet of the upper side walls, this now gives rise, at the outlet of said upper side walls, and taking into consideration the heating imbalances in the heating surface, to lower maximum outlet temperatures in relation to the conventional connection configuration of the steam generator tubes, even though the mean inlet temperature has increased owing to the heat absorbed in the front wall and rear wall.

BRIEF DESCRIPTION OF THE DRAWINGS

The sole FIGURE schematically illustrates a side view of a possible exemplary embodiment of the continuous flow steam generator according to the invention.

DETAILED DESCRIPTION OF INVENTION

The invention will now be discussed by way of example on the basis of a FIGURE. Here, the FIGURE schematically illustrates a side view of a possible exemplary embodiment of the continuous flow steam generator according to the invention. The continuous flow steam generator comprises a combustion chamber 1 with a lower combustion chamber region 11 and an upper combustion chamber region 12, wherein a horizontal gas pass 2 adjoins the upper combustion chamber region 12. The horizontal gas pass may then be adjoined by a vertical gas pass that is not illustrated further. A number of burners (not shown in any more detail) are provided in the lower combustion chamber region 11, which burners effect combustion of a liquid, solid or gaseous fuel in the combustion chamber 1. The flue gas generated by the combustion then flows into the upper combustion chamber region 12, and from there into the horizontal gas pass 2. The enclosure walls of the combustion chamber and of the horizontal gas pass 2 are formed from steam generator tubes 10 which are welded together in gas-tight fashion and into which, by way of a pump that is not shown in any more detail, there is pumped a flow medium—conventionally water—which is heated by the flue gas generated by the burners. In the lower combustion chamber region 11, the steam generator tubes 10 may, in part or over the entire length, be oriented vertically and/or in helical or spiral-shaped fashion. Although comparatively higher outlay in terms of construction is required in the case of a spiral-shaped arrangement, it is obtained in exchange that the heating differences that arise between steam generator tubes connected in parallel are comparatively smaller than in the case of a combustion chamber 1 with exclusively vertical tubing. The continuous flow steam generator that is shown furthermore comprises, for improvement of the flue gas guidance, a nose N which is formed from steam generator tubes of the rear wall R and which projects into the combustion chamber. The steam generator tubes of the combustion chamber walls are designed as evaporator tubes. The flow medium is evaporated therein and is supplied, via outlet collectors 32, 36 and 40 at the upper end of the combustion chamber, to a water separation system 5. In the water separation system 5, water that has not yet evaporated is collected and discharged. This is necessary in particular during start-up operation, when it is necessary, for reliable cooling of the steam generator tubes, for a greater flow rate of flow medium to be pumped in than can be evaporated during one pass through the tubes. The steam that is thus generated is conducted into the inlet collectors 6 of the downstream superheater tubes 7, which in this case form the ceiling of the continuous flow steam generator.

The collectors that are conventionally arranged and connected in the region of the transition from lower combustion chamber 11 to upper combustion chamber 12 and which are in the form of passage collectors in this case form a separating point between the steam generator tubes of the lower and upper combustion chamber regions 11 and 12. It is precisely this that the invention is directed to. According to the invention, it is now provided that, at this separating point, first collectors 31, 33 and 34 are arranged and connected such that the flow medium from the first heating surface segments H1 and H2 of the two parallel side walls S as first enclosure walls of the lower combustion chamber region 11 can be admixed to the flow medium from second heating surface segments H9 and H10 of the front wall F and rear wall R of the upper combustion chamber region 12 as second enclosure wall. Here, it must be ensured that, in the upper combustion chamber region 12, the tubing of the rear wall R above the first collectors 31 transitions seamlessly into a region formed as a nose N, and then into a subsequent grate G at the outlet of the horizontal pass 2, and thus jointly form the heating surface segments H10 of a rear wall assembly. This means that, in this case, the flow medium emerging from the heating surface segments H7 and H8 of the lower combustion chamber region 11 has additional flow medium from the lateral heating surface segments H1 and H2 of the lower combustion chamber region 11 admixed to it in the upper combustion chamber region 12, and thus, in the upper combustion chamber region 12, in the heating surface segments H9 and H10 of the front wall and of the rear wall assembly formed from R, N and G, the mass flow of the flow medium is increased. Since the combustion chambers of power plants generally have a rectangular cross section, the front wall and the rear wall or the rear wall assembly are thus arranged orthogonally with respect to the parallel side walls. Together with further ceiling walls and side walls, they then form the enclosure walls of the combustion chamber and of the horizontal gas pass connected downstream at the flue gas side. In the present exemplary embodiment, it is furthermore the case, at the outlet of the front wall F and of the grate G, that collectors 35 and 37 in the form of outlet collectors are provided at the upper end of the upper combustion chamber region 12 and are connected to in each case one downpipe 4 on each side of the parallel side walls S such that the flow medium from the second heating surface segments H9 of the second enclosure wall F of the upper combustion chamber region 12 and H10 of the rear wall R, of the nose N and of the grate G of the horizontal gas pass 2 can be supplied to third heating surface segments H3-H5 of the lateral enclosure walls S of the upper combustion chamber region 12 and/or to fourth heating surface segments H6 of lateral enclosure walls of the horizontal gas pass 2 and/or via a collector 36' to a combustion chamber outlet grate ZG arranged at the transition between upper combustion chamber region 12 and horizontal gas pass 2. The flow medium then flows through said heating surface segments from bottom to top, is collected in the collectors 32, 36 and 40, and is supplied to the water separation system 5.

In the further embodiment shown here, it is furthermore the case that the steam generator tubes 10 of the heating surface segments H1 composed of corner wall regions of the lower combustion chamber region 11 are connected by way of the passage collectors 31 and 33 to heating surface segments composed of central wall regions (not illustrated in any more detail) of the front-side enclosure wall and of the rear enclosure wall assembly of the upper combustion chamber region 12. Correspondingly, the steam generator tubes 10 of the heating surface segments H2 composed of the central wall regions of the lower combustion chamber region 11 are connected by way of the collectors 31 and 34 to heating surface segments composed of corner wall regions of the front-side enclosure wall and of the upper rear wall assembly. The segmentation of the front wall F and of the rear wall, or of the rear wall assembly formed from parts of the rear wall R of the upper combustion chamber region 12, from the nose N and from the grate G, is not visible in the FIGURE owing to the lateral illustration, though may be realized similarly to the segmentation of the illustrated side walls into corresponding heating surface segments.

Advantages arise in the case of the connection configuration according to the invention of the steam generator tubes and collectors in particular with regard to the cooling of the enclosure walls and with regard to the temperature imbalances in the upper combustion chamber region 12. The higher mass flow densities improve the internal heat transfer. The shorter warm-up spread in the front wall and rear wall with subsequent nose, horizontal gas pass base and grate leads to lower outlet temperatures. There is also the positive effect of the targeted admixing of the flow medium from the side walls at the inlet of the upper front wall and rear wall. Also, for the side walls in the upper combustion chamber region 12, the connection configuration is advantageous because the flow medium at the inlet has been fully mixed, and it can thus be assumed that there are no longer temperature imbalances in the inlet collectors. The connection configuration according to the invention of the steam generator tubes of the combustion chambers of a continuous flow steam generator designed as a two-pass boiler duly entails additional outlay in terms of construction for the pipelines between the lower side wall outlet collectors and the upper front wall and rear wall, and additional collectors at the inlet of the upper side walls. However, by way of the connection configuration according to the invention, it is accordingly possible to substantially avoid the use of the materials T23 and T24 and the associated difficulties in terms of processing, and furthermore, with the connection configuration according to the invention, operating states of power plants are also conceivable in which the continuous flow steam generator, or else a continuous flow steam generator in the form of a continuous forced-flow steam generator, is intended to be operated with higher fresh steam temperatures in the range from 600° C. to 700° C. This can be achieved, in principle, with any manner of interconnection configuration of heating surface segments that effects a local admixing of flow medium. It would accordingly likewise be possible for an arrangement to be provided in which flow medium from heating surface segments of the front wall F and rear wall R from the lower combustion chamber region 11 is admixed to heating surface segments of the side walls S from the upper combustion chamber region 12.

The invention claimed is:

1. A continuous flow steam generator having:

a combustion chamber which is of substantially rectangular cross section and which has a lower and an upper combustion chamber region, having a horizontal gas pass which is connected downstream of the combustion chamber at the flue gas side, wherein gas-tight and gas-permeable enclosure walls of the continuous flow steam generator are formed from welded-together steam generator tubes through which a flow medium can flow, and wherein collectors are arranged and connected to the steam generator tubes such that groups of steam generator tubes connected in parallel form heating surface segments of the enclosure walls, first passage collectors arranged and connected such that the flow medium from first heating surface segments of two parallel first enclosure walls from the lower combustion chamber region can be admixed to the flow medium from second heating surface segments of second enclosure walls from the upper combustion chamber region, wherein the first passage collectors are perpendicular to the first enclosure walls, and first corner heating surface segments composed of corner wall regions of the first enclosure walls from the lower combustion chamber region, wherein the second heating surface segments comprise central wall regions of the second enclosure walls, and wherein the first passage collectors are connected such that flow medium from the first corner heating surface segments can be supplied and/or admixed to the central wall regions of the second heating surface segments.

2. The continuous flow steam generator as claimed in claim 1, wherein the second enclosure walls are a front wall and a rear wall assembly, formed from a part of the rear wall, from a nose and from a grate, of the upper combustion chamber region, and furthermore the first enclosure walls are two side walls of the lower combustion chamber region.

3. The continuous flow steam generator as claimed in claim 1, further comprising:

second collectors and at least one downpipe arranged and connected such that the flow medium from the second heating surface segments of the second enclosure walls of the upper combustion chamber region can be supplied to third heating surface segments of the first enclosure walls of the upper combustion chamber region.

4. The continuous flow steam generator as claimed in claim 3, wherein via the at least one downpipe, flow medium can be supplied to fourth heating surface segments of lateral enclosure walls of the horizontal gas pass and/or to a combustion chamber outlet grate arranged at the transition between upper combustion chamber region and horizontal gas pass.

5. The continuous flow steam generator as claimed in claim 1, further comprising:

second corner heating surface segments composed of corner wall regions of the second enclosure walls from the upper combustion chamber region;

wherein the first heating surface segments comprise central wall regions of the first enclosure walls;

wherein the first passage collectors are connected such that flow medium from the central wall regions of the first heating surface segments can be supplied and/or admixed to the second corner heating surface segments.

6. A continuous flow steam generator comprising:

a combustion chamber comprising: a substantially rectangular cross section; a lower and an upper combustion chamber region; and a horizontal gas pass which is connected downstream of the combustion chamber at the flue gas side, wherein gas-tight and gas-permeable enclosure walls of the continuous flow steam generator are formed from welded-together steam generator tubes through which a flow medium can flow, and wherein collectors are arranged and connected to the steam generator tubes such that groups of steam generator tubes connected in parallel form heating surface segments of the enclosure walls, first passage collectors arranged and connected such that the flow medium from first heating surface segments of two parallel first enclosure walls from the lower combustion chamber region can be admixed to the flow medium from second heating surface segments of second enclosure walls from the upper combustion chamber region, wherein the first passage collectors are perpendicular to the first enclosure walls, and second corner heating surface segments composed of corner wall regions of the second enclosure walls from the upper combustion chamber region, wherein the first heating surface segments comprise central wall regions of the first enclosure walls, and wherein the first passage collectors are connected such that flow medium from the central wall regions of the first heating surface segments can be supplied and/or admixed to the second corner heating surface segments.

7. The continuous flow steam generator as claimed in claim 6, wherein the second enclosure walls are a front wall and a rear wall assembly, formed from a part of the rear wall, from a nose and from a grate, of the upper combustion chamber region, and furthermore the first enclosure walls are two side walls of the lower combustion chamber region.

8. The continuous flow steam generator as claimed in claim 6, further comprising:

second collectors and at least one downpipe arranged and connected such that the flow medium from the second heating surface segments of the second enclosure walls of the upper combustion chamber region can be supplied to third heating surface segments of the first enclosure walls of the upper combustion chamber region.

9. The continuous flow steam generator as claimed in claim 8, wherein via the at least one downpipe, flow medium can be supplied to fourth heating surface segments of lateral enclosure walls of the horizontal gas pass and/or to a combustion chamber outlet grate arranged at the transition between upper combustion chamber region and horizontal gas pass.

10. The continuous flow steam generator as claimed in claim 6, further comprising:

first corner heating surface segments composed of corner wall regions of the first enclosure walls from the lower combustion chamber region;

wherein the second heating surface segments comprise central wall regions of the second enclosure walls;

wherein the first passage collectors are connected such that flow medium from the first corner heating surface segments can be supplied and/or admixed to the central wall regions of the second heating surface segments.

11. A continuous flow steam generator comprising:

a combustion chamber comprising: a substantially rectangular cross section; a lower combustion chamber region; an upper combustion chamber region; and a horizontal gas pass which is connected downstream of the combustion chamber at the flue gas side, a first, a second, a third, and a fourth enclosure wall, each enclosure wall formed from welded-together steam generator tubes through which a flow medium can flow, wherein the first and third enclosure walls are parallel to each other and perpendicular to the second and fourth enclosure walls, heating segments formed by groups of the steam generator tubes connected in parallel, first passage collectors connected to the steam generator tubes such that the flow medium from first heating surface segments of the first, the second, the third, and the fourth enclosure walls of the lower combustion chamber region are admixed together and delivered as a combined flow to second heating surface segments of the first and the third enclosure walls of the upper combustion chamber region, and second passage collectors connected to the steam generator tubes such that the combined flow is then delivered from the second heating surface segments of the first and the third enclosure walls to the second and the fourth enclosure walls of the upper combustion chamber region.

* * * * *